US011007496B2

(12) United States Patent
Kamimura et al.

(10) Patent No.: US 11,007,496 B2
(45) Date of Patent: May 18, 2021

(54) METHOD FOR MANUFACTURING ULTRA-FINE BUBBLES HAVING OXIDIZING RADICAL OR REDUCING RADICAL BY RESONANCE FOAMING AND VACUUM CAVITATION, AND ULTRA-FINE BUBBLE WATER MANUFACTURING DEVICE

(71) Applicant: JOHOKAGAKU KENKYUSYO CO. LTD., Kumamoto (JP)

(72) Inventors: Chikashi Kamimura, Kumamoto (JP); Takashi Kamimura, Kumamoto (JP)

(73) Assignee: JOHOKAGAKU KENKYUSYO CO. LTD., Kumamoto (JP)

( * ) Notice: Subject to any disclaimer, the term of this patent is extended or adjusted under 35 U.S.C. 154(b) by 87 days.

(21) Appl. No.: 16/552,958

(22) Filed: Aug. 27, 2019

(65) Prior Publication Data

US 2020/0094205 A1 Mar. 26, 2020

Related U.S. Application Data

(62) Division of application No. 15/500,433, filed as application No. PCT/JP2015/073920 on Aug. 5, 2015, now Pat. No. 10,500,553.

(30) Foreign Application Priority Data

Aug. 22, 2014 (JP) ..... 2014-183658

(51) Int. Cl.
*B01F 11/02* (2006.01)
*B01F 3/04* (2006.01)
(Continued)

(52) U.S. Cl.
CPC ..... *B01F 11/0283* (2013.01); *B01F 3/04503* (2013.01); *B01F 3/04978* (2013.01);
(Continued)

(58) Field of Classification Search
CPC .... B01F 11/0283; B01F 3/04503; B01F 5/16; B01F 5/043; B01F 3/04978;
(Continued)

(56) References Cited

U.S. PATENT DOCUMENTS 3,613,141 A * 10/1971 Sawyer ..... A47L 11/12 15/98
5,514,267 A * 5/1996 Machiya ..... B01F 5/0415 210/170.06
(Continued)

FOREIGN PATENT DOCUMENTS

JP S53-016963 A 2/1978
JP S61-132028 A 8/1986
(Continued)

*Primary Examiner* — Tony G Soohoo
(74) *Attorney, Agent, or Firm* — Greer, Burns & Crain, Ltd.

(57) ABSTRACT

A method is provided for producing fine-bubble water by resonance foaming and vacuum cavitation, and a device for manufacturing each of ultra-fine-bubble water of hydrogen gas having a reducing radical function, ultra-fine-bubble water of air and oxygen gas having an oxidizing radical function, ozone ultra-fine-bubble water having a sterilization function enabled by ozone, and fine-bubble water of nitrogen/carbon dioxide gas for increasing the ability to preserve the freshness of raw agricultural products, livestock products, and marine products.

4 Claims, 6 Drawing Sheets

(51) Int. Cl.

| | |
|---|---|
| ***B01F 5/16*** | (2006.01) |
| ***B01F 5/04*** | (2006.01) |
| ***B01F 5/12*** | (2006.01) |
| ***B01F 15/00*** | (2006.01) |
| ***B01F 15/02*** | (2006.01) |

(52) U.S. Cl.
CPC ..... *B01F 5/043* (2013.01); *B01F 5/12* (2013.01); *B01F 5/16* (2013.01); *B01F 11/0208* (2013.01); *B01F 15/00149* (2013.01); *B01F 15/00162* (2013.01); *B01F 15/00331* (2013.01); *B01F 15/00357* (2013.01); *B01F 15/0243* (2013.01); *B01F 2003/04858* (2013.01); *B01F 2003/04872* (2013.01); *B01F 2003/04879* (2013.01); *B01F 2003/04886* (2013.01); *B01F 2003/04893* (2013.01); *B01F 2003/04914* (2013.01); *B01F 2003/04921* (2013.01)

(58) Field of Classification Search
CPC ..... B01F 11/0208; B01F 15/00149; B01F 15/00162; B01F 15/00331; B01F 15/00357; B01F 15/0243; B01F 5/12; B01F 2003/04914; B01F 3/04099; B01F 5/06; B01F 15/02; B01J 19/10
See application file for complete search history.

(56) References Cited

U.S. PATENT DOCUMENTS

| | | | | |
|---|---|---|---|---|
| 5,938,982 | A * | 8/1999 | Sugiura | B01F 5/0659 261/75 |
| 6,039,309 | A | 3/2000 | Kuklinski | |
| 6,142,456 | A | 11/2000 | Machiya et al. | |
| 8,317,165 | B2 | 11/2012 | Yamasaki et al. | |
| 8,557,122 | B2 | 10/2013 | Kijima et al. | |
| 8,720,867 | B2 * | 5/2014 | Cunningham | A61H 33/02 261/29 |
| 10,029,219 | B2 | 7/2018 | Tamura et al. | |
| 2007/0034556 | A1 * | 2/2007 | Kamimura | B01F 3/04496 210/97 |
| 2007/0189972 | A1 | 8/2007 | Chiba et al. | |
| 2009/0117241 | A1 | 5/2009 | Tsuji | |
| 2010/0089133 | A1 * | 4/2010 | Yamasaki | B01F 3/04106 73/61.41 |
| 2011/0301531 | A1 | 12/2011 | Spears et al. | |
| 2012/0003707 | A1 * | 1/2012 | Hickey | C12P 7/065 435/141 |
| 2013/0010035 | A1 * | 1/2013 | Norikane | B41J 2/14233 347/70 |
| 2013/0160688 | A1 | 6/2013 | Whiteside et al. | |
| 2013/0267006 | A1 * | 10/2013 | Koepke | C12N 9/0006 435/190 |
| 2013/0334335 | A1 * | 12/2013 | Wilkerson | B05B 7/0012 239/4 |
| 2014/0072502 | A1 * | 3/2014 | Enomura | B01F 3/04106 423/422 |
| 2015/0273408 | A1 * | 10/2015 | Tachibana | B01F 15/00538 366/162.4 |
| 2015/0314248 | A1 * | 11/2015 | Castellote | A61H 33/027 261/29 |
| 2015/0336029 | A1 * | 11/2015 | Kobayashi | B01D 19/0068 95/243 |
| 2017/0218318 | A1 * | 8/2017 | Kamimura | C12G 3/022 |
| 2018/0141837 | A1 * | 5/2018 | Kim | B01F 3/04531 |
| 2018/0231902 | A1 * | 8/2018 | Miyakoshi | G03G 9/08795 |

FOREIGN PATENT DOCUMENTS

| | | | |
|---|---|---|---|
| JP | S63-274496 | A | 11/1988 |
| JP | H07-088346 | A | 4/1995 |
| JP | H08-056632 | A | 3/1996 |
| JP | H10-118653 | A | 5/1998 |
| JP | 2000-000447 | A | 1/2000 |
| JP | 2005-246294 | A | 9/2005 |
| JP | 2006-142300 | A | 6/2006 |
| JP | 2007-209953 | A | 8/2007 |
| JP | 2007-307450 | A | 11/2007 |
| JP | 2008-142592 | A | 6/2008 |
| JP | 2009-011999 | A | 1/2009 |
| JP | 2009-039600 | A | 2/2009 |
| JP | 2009-101269 | A | 5/2009 |
| JP | 2009-195887 | A | 9/2009 |
| JP | 2009-195888 | A | 9/2009 |
| JP | 2011-062669 | A | 3/2011 |
| JP | 2011-078858 | A | 4/2011 |
| JP | 2011-110040 | A | 6/2011 |
| JP | 2011-230055 | A | 11/2011 |
| JP | 2011-240206 | A | 12/2011 |
| JP | 2013-071047 | A | 4/2013 |
| JP | 2015-093205 | A | 5/2015 |

* cited by examiner

METHOD FOR MANUFACTURING ULTRA-FINE BUBBLES HAVING OXIDIZING RADICAL OR REDUCING RADICAL BY RESONANCE FOAMING AND VACUUM CAVITATION, AND ULTRA-FINE BUBBLE WATER MANUFACTURING DEVICE

RELATED APPLICATION

This application is a divisional application of and claims 35 USC 120 priority from U.S. patent application Ser. No. 15/500,433 filed Jan. 30, 2017, which is also a U.S. National Stage Application of and claims priority to International Application No. PCT/JP2015/073920 filed Aug. 5, 2015, which is incorporated by reference.

BACKGROUND

The present invention relates to a manufacturing method for and a manufacturing apparatus of ultra-fine bubbled water (water including bubbles) that contains oxidizing radicals or reductive radicals. The invention employs vacuum cavitation originated from a vacuum generated by the difference between the liquid supply capability of a pump and the liquid sucking capability of the other pump, in which the two pumps sandwich a resonance ejector and a resonance bubble-forming device.

The study on microbubbles and nanobubbles has just started 25 to 30 years ago. In *EXPO* 2005 Aichi, Mr. Masayoshi Takahashi of the National Institute of Advanced Industrial Science and Technology demonstrated that sea bream, which is saltwater fish, and carp, which is freshwater fish, can cohabit in the same fish tank filled with the water containing microbubbles, which aroused the global interest in microbubbles.

In the early 2000s, the applicant of the present invention also studied microbubbles of hydrogen, and obtained patents of reductive hydrogen water for the first time internationally. In the reports on international standardization promotion activities for microbubbles and nanobubbles technologies in fiscal 2012, which was sponsored by the Japanese Ministry of Economy, Trade and Industry, microbubbles and nanobubbles are provisionally defined based on the bubble size such that the air bubble having the size of 0.8 mm-1 mm or more is called a bubble, the air bubble having the size of 0.05 mm-0.1 mm or more and smaller than the "bubble" is called a submillimeter bubble, the air bubble having the size of 20 μm-1 μm and smaller than the "submillimeter bubble" is called a microbubble, and the air bubble having the size of 20 μm-1 μm or less is called a ultra-fine bubble.

The methods for manufacturing microbubbles include the following: a simple ejector method, a venturi tube method, an SPG membrane pass method, a pressurization-depressurization method, an ultrasonic vibration method, a gas-liquid swirling two-phase method, and a cavitation method (including the cavitation generated in the back of a screw).

Among the above-mentioned methods, the pressurization-depressurization method, the ultrasonic vibration method, the gas-liquid swirling two-phase method, and the cavitation method are considered to be capable of generating nano-sized ultra-fine bubbles.

Because the nanobubbles of air or oxygen promote the growth of a living body, they are effective in use for the cultivation of crops, farming fishery, poultry raising, pig farming, fattening of cattle, and other uses. The growth of the living body is fast, and accordingly the amount of feed supplied to the living body is reduced, whereby large economic effects are realized.

Also, ultra-fine bubbles in oxidative conditions increase the oxygen concentration in a water system, which causes to promote the growth of organisms useful for purification of the water system.

Ultra-fine hydrogen-bubbled water (water including bubbles of hydrogen gas) has an anti-oxidizing function that is active in a living body, which is believed to be effective in exerting an anti-aging effect, in preventing lifestyle-related diseases, and in preventing cancer.

Recent studies show that the ultra-fine bubble hydrogen water is effective in cancer treatment, whereby water containing hydrogen has been widely sold under the names of hydrogen water, active hydrogen water, and nanobubble hydrogen water.

Also, a study made by the applicant of the present invention has confirmed that providing magnetizing treatment to the process in generating hydrogen microbubbles can produce free-radical scavenging microbubbled water.

A lot of patent applications regarding microbubbles and hydrogen water have been filed to date. The applicant has selected representative patent documents describing manufacturing methods of fine bubbles, and will explain the difference between each invention described in those documents and this application's invention.

Comparison Between Each Invention in the Prior-Art Documents and the Present Invention Patent Document 1 is titled "Swirling fine-bubble generator" and the first invention disclosed a manufacturing method of microbubbles. The generator is provided with a container unit including a conical space or a bottle-like space, a liquid inlet provided in a tangential direction on a part of the circumferential surface of the inner wall of the space, a gas introducing hole provided on the bottom of the space, and a swirling gas-liquid outlet arranged at the top of the space.

The present invention generates fine bubbles by resonance bubble-forming and vacuum cavitation. The present invention fundamentally differs in the manufacturing method of the fine bubbles from the Patent Document 1.

Patent Document 2 discloses an invention relating to generation of fine bubbles using ultrasonic waves. The title of the invention is "Method of forming nanobubbles." This document has introduced quite new insights regarding the physicochemical characteristic of fine bubbles by showing, for example, that freshwater fish and saltwater fish can be grown in the same tank. The present invention relates to a method of generating fine bubbles by resonance bubble-forming and vacuum cavitation. The manufacturing method of the fine bubbles of the present invention fundamentally differs from that of Patent Document 2.

Patent Document 3 discloses an invention relating to generation of fine oxygen-bubbles using ultrasonic wave. The title of the invention is "Nano oxygen-bubbled water and production method therefore." The present invention generates fine bubbles by resonance bubble-forming and vacuum cavitation. The manufacturing method of the fine bubbles of the present invention fundamentally differs from that of Patent Document 3.

Patent Document 4 discloses an invention relating to the manufacturing method of microbubbles. The title of the invention is "Whirling type fine bubble formation apparatus." Provided is a high efficiency whirling-type fine-bubble formation apparatus, in which a large quantity of fine bubbles can be formed while preventing occurrence of cavitation erosion. The apparatus is provided with a gas-liquid whirling chamber being a space which is formed inside a cylindrical casing and in which gas and liquid can whirl, a liquid introducing port for introducing liquid into the gas-liquid whirling chamber, a gas introducing port which is disposed in a center of one of end part wall surface of the casing and which introduces gas into the gas-liquid whirling chamber, and a gas-liquid discharge port which is disposed in the center of the end part wall surface of the casing facing the gas introduction port. The gas-liquid whirling chamber is provided with a main whirling part in which the liquid introduced from the liquid introducing port is brought in contact with the gas introduced from the gas introducing port. The present invention generates fine bubbles by resonance bubble-forming and vacuum cavitation. The manufacturing method of the fine bubbles of the present invention fundamentally differs from that of Patent Document 4.

Patent Document 5 discloses an invention, whose title is the name of "Fine bubble generating system." The apparatus of this invention generates fine bubbles by a Venturi tube, cavitation by a pump, and orifice plates. Paragraph 0054 in the document states that when liquid pass through a bubble break-up part 5, which is an orifice O, bubbles break up and fine bubbles are generated. Further, Paragraph 0055 states that if the bubble break-up part 5 includes the orifice O, the pressure fluctuation of the liquid L that passes through the through hole of the orifice O generates bubbles B without cavitation. However, although this method can break up bubbles, it is not possible for this method to make uniform bubbles throughout the liquid like the bubbles generated by resonance bubble-forming. Also, this invention has the feature that the water containing fine bubbles discharged from the Venturi tube is subjected to a reduced pressure so as to break up the bubbles. Since the Venturi tube is pipe-shaped, even if water is transferred under a reduced pressure state, a light reduced pressured state is maintained, but a vacuum state is not created. In the present invention, a resonance ejector functions as a weir and more than a certain level of water supply cannot be not made, generating a vacuum. This feature differentiates the present invention from the invention of Patent Document 5.

Patent Document 6 discloses an invention whose title is "Fine bubble generator." The device is provided with a gas suction port, an orifice and a guide at a gas suction port of a pump, and bubbles are crushed by cavitation. Specifically, the fine-bubble generation device, which functions as a pump, generates cavitation by a revolving impeller, which makes the bubbles finer. However, although it is possible to generate fine bubbles by using an orifice and cavitation generated by the impeller, this simple method is not capable of generating uniform-sized microbubbles, and fails to make the generated fine bubbles spread throughout the liquid by resonance bubble-forming.

Patent Document 7 discloses an invention whose title is "Ultra-fine bubble production device." This device makes the sucked air finer in water by cavitation generated by the impeller of a turbo fan. In this method, because water continuously flows into the device, an appropriate reduced pressure state cannot be created, and vacuum cavitation is not brought out. This device also does not generate uniform-sized fine bubbles by resonance bubble-forming, buts focuses on accumulating fine bubbles through crushing bubbles in the process of circulation of water. The present invention provides the technique by which ultra-fine bubbles are generated in a moment by resonance bubble-forming and vacuum cavitation, which differs from the technique disclosed in Patent Document 7.

Patent Document 8 discloses an invention whose title is "Apparatus for and method of manufacturing nanobubble-containing liquid." This apparatus generates fine bubbles in each of the first to third air shearing sections of a submerged-pump-type microbubble generation part in the first tank using the air sent from an electric needle valve, transfers the liquid to the second tank using a circulation pump, and in a water stream generation pipe provided to the second tank, the liquid is mixed with gas sent from a blower, and is stirred and circulated in a submerged agitator. This apparatus uses shearing method to make fine bubbles, and uses the electric needle valve to introduce gas into the liquid, but does not use the resonance bubble-forming technology of the present invention. The electric needle valve is not used as a resonance bubble-forming adjusting valve, but used as an electromagnetic switching device. Also, the method for generating fine bubbles in Patent Document 7 differs from the resonance bubble-forming technology and vacuum cavitation of the present invention.

Patent Document 9 discloses an invention whose title is "Nanobubble-containing liquid producing apparatus and nanobubble-containing liquid producing method." This is a huge apparatus consisting of uses of four tanks to manufacture nanobubbles. The first tank stores raw water, and the raw water is transferred from the first tank to the second tank using the first transfer pump. In the second tank, air is sent to a microbubble generator from a small blower through a needle valve to generate bubble-liquid flow. The water that has overflowed the second tank is sent to the third tank, and in the third tank, water is circulated through a micro-nanobubble generator to generate micro nanobubbles. The micro nanobubbles in the third tank are sent to the fourth tank, and in the fourth tank, water is circulated through a nanobubble generator to generate nanobubbles.

This invention intends to generate nanobubbles using multistage treatment of liquid, which is similar to the present invention, but this invention differs from the present invention in that the configuration is large compared with that of the present invention because a liquid storage container is included. When liquid is sucked from the container by a pump, realized pressure reduction is lower than that of the present invention because the size of the container is large, and liquid is supplied from a liquid supply device and a microbubble generation device. Furthers, it is not possible to move this device easily. The present invention provides a light weight, movable apparatus, and provides a technique using resonance bubble-forming and vacuum cavitation, which completely differentiates the present invention from the invention of Patent Document 9.

Patent Document 10 discloses an invention whose title is "Drinking water, using method of drinking water, refining method of drinking water and drinking water generating device." Water supplied from outside is mixed with gas in a pipe, the mixed gas is made into fine bubbles by the Venturi tube method, and the fine bubbles are crushed and made into nano-sized bubbles by external forces such as the change of pressures, the change of temperatures, shocks and ultrasonic waves.

The gases used include ozone, chlorine, chlorine dioxide, hydrogen, carbon dioxide, oxygen, nitrogen, and argon. The technique used by this invention is completely different from the technique of resonance bubble-forming and vacuum cavitation used by the present invention.

Patent Document 11 discloses an invention whose title is "Method for generating microbubbles and microbubble generator." The device is a circulation-type microbubble manufacturing device. The device uses a technique to concentrate and accumulate microbubbles in such a way that water is sucked from a microbubble storage water tank 5 by a pump 7, the passage of the water is changed by opening or closing of flowing water control valves, fine bubbles are generated in a microbubble generation device that has an aspirator function, the water containing microbubbles is introduced to a liquid container 2 where microbubbles are stored temporarily, and the water is circulated between the microbubble storage water tank 5 and the liquid container 2, the flowing water direction being controlled by opening or closing of flowing-water control valves. The configuration that a secondary pump 22 is provided between the liquid container 2 and the microbubble storage water tank 5 is similar to that of the present invention.

This configuration is provided to supply water and to circulate the liquid within the treatment system, in which the pump is operated to supply the liquid from the liquid container 2 to the storage water tank 5, and is not operated to generate a reduced pressure state. This invention does not assume that a vacuum is necessary to spread bubbles. In the present invention, a resonance ejector functions as a weir and more than a certain level of water is not supplied, which generates a vacuum. Also, the method for generating fine bubbles disclosed in Patent Document 11 is different from the method for manufacturing fine bubbles by resonance bubble-forming and vacuum cavitation disclosed by the present application.

Patent Document 12 is an invention titled "Reductive hydrogen water for food or the like, its production and producing apparatus" by this application's inventor, and the first granted patent relating to "hydrogen water" in Japan. In this method, hydrogen gas is blown into water so as to manufacture hydrogen water having reductive properties.

Patent Document 13 is titled "Electrolytic hydrogen dissolved water and method and apparatus of production thereof" and the first granted a patent relating to manufacturing of alkali reduced water (electrolytically reduced water) in Japan. The method disclosed is as follows. Purified water is obtained from tap water. NaCl is added to the purified water so that the conductivity thereof is at least 100 μS/cm. Then, electrolysis is applied. The obtained cathode water is output and neutralized. The obtained cathode water includes dissolved hydrogen ($H^+$, H., $H_2$) of at least 0.1 ppm. This dissolved hydrogen prevents or suppresses DNA damage.

Patent Document 14 is titled "Automatic oxidization-reduction treatment system using a colloidal solution of hydrogen gas or oxygen gas produced under a reduced pressure and a high pressure" by this application's inventor, and is the first granted patent relating to manufacturing of functional hydrogen water using fine bubbles in Japan. In this invention, gas is added to water under reduced pressure, the water is stirred by a pump, which causes cavitation, and fine bubbles are generated by pressurization. However, this method does not employ vacuum cavitation. In this method, if oxidation is required to meet the end use, oxygen or air is added to the water. If reduction is required, hydrogen is added to the water. However, this method does not employ vacuum cavitation.

Patent Document 15 titled "Production system and production method for reduced water with hydrogen radical pressure-dissolved therein" by this application's inventor, and is the first granted patent relating to manufacturing of hydrogen water having free radical scavenging properties in Japan. This invention provides a device, in which hydrogen gas is mixed with water in a magnetic field, and antioxidative hydrogen water is manufactured by cavitation.

Patent Document 16 discloses an invention relating to manufacturing of nanobubbles of hydrogen. The title of the invention is "Method and system for producing nanobubbles fucoidan water." In this method, water is subjected to reduced pressure, and hydrogen supplied from multiple supply ports is added to the water. Hydrogen is added from a number of hydrogen-supply-holes into the water in a reduced pressure to build up multiple bubble-crushing walls and generates nanobubbles of hydrogen by the resulting cavitation. The mechanism disclosed in this document is basically similar to those disclosed in Patent Document 14 or Patent Document 15, but this method does not employ vacuum cavitation.

Prior-Art Patent Documents Concerning Microbubbles and Nanobubbles

Patent Document 1: JP-A-2000-447
Patent Document 2: JP-A-2005-245817
Patent Document 3: JP-A-2005-246294
Patent Document 4: JP-A-2006-142300
Patent Document 5: JP-A-2007-209953
Patent Document 6: JP-A-2008-142592
Patent Document 7: JP-A-2009-039600
Patent Document 8: JP-A-2009-195887
Patent Document 9: JP-A-2010-089055
Patent Document 10: JP-A-2011-062669
Patent Document 11: JP-A-2011-078858

Prior-Art Patent Documents Concerning Hydrogen Water

Patent Document 12: JP-A-H08-056632
Patent Document 13: JP-A-H10-118653
Patent Document 14: JP-A-2004-344859
Patent Document 15: JP-A-2009-011999
Patent Document 16: JP-A-2011-230055

SUMMARY

Currently prevalent microbubble generation method mainly uses shearing of a gas-liquid mixture, in which the bubbles generated using this method are not uniform in size. Another technique used employs cavitation under reduced pressure conditions after sucking microbubbles from a microbubble storage tank so as to reduce the size of bubbles to 1 μm or less. In this technique, microbubbles are supplied to the microbubble storage tank continuously, and no measures are applied to control the continuous supply of the microbubbles, whereby the microbubbles are produced under light pressure reduction conditions while the microbubbles are being circulated.

Other nanobubble generation techniques used employ the methods to store treated liquid that contains bubbles in a storage tank so as to treat the stored liquid repeatedly because one-time treatment is not sufficient to obtain desired bubbles. Also, currently prevalent nanobubble generation devices have poor generating power in principle, and are capable of treating the volume of one ton or less per minute. There have not been developed techniques that are capable of discharging a large quantity of ultra-fine bubbles directly from an apparatus.

In order to provide a solution to this problem, the present invention provides two pumps consisting of a primary pump and a secondary pump, which generate a reduced pressure state, and provides also a resonance ejector and a resonance forming device sandwiched between the two pumps so that a large amount of ultra-fine bubbles can be generated with one-time treatment.

The primary pump sucks water and jets out the water, the resonance ejector mixes the water and gas to form a gas-liquid mixture, the resonance bubble-forming device generates uniform microbubbles. The volume of water discharged from the resonance ejector is constant, and therefore if a secondary pump that is capable of sucking more water than the discharged water sucks the discharged water, a reduced pressure state is produced. The generated reduced pressure state and the cavitation by the secondary pump enables to transform the generated microbubbles into the ultra-fine bubbles in a moment.

In the prior-art, fine bubbles have been generated such that gas and liquid are mixed, and the mixture thereof is sheared by cavitation of an ejector or an agitator. The method using shearing inevitably generates various sizes of fine bubbles. The technique of resonance bubble-forming to generate fine bubbles has not been proposed.

In order to make the size of the fine bubbles uniform, generating a reduced pressure state in a resonance device and performing resonance bubble-forming therein can realize generation of almost uniform-sized fine bubbles. However, simply using the technique of resonance bubble-forming generates micro-sized fine bubbles, and therefore, subjecting the generated fine bubbles to vacuum cavitation under an appropriate reduced pressure state can expand the fine bubbles so as to be crushed, so that the fine bubbles become nano-sized fine bubbles. This method is capable of forming almost uniform-sized, ultra-fine bubbles.

Accordingly, in order to produce a large quantity of ultra-fine bubbled water, or ultra-fine bubble hydrogen water, use of resonance bubble-forming and vacuum cavitation is required. The resonance bubble-forming is performed such that water from the primary pump is transferred to the resonance ejector, gas is sucked so as to be mixed with the water, the pressure conditions are adjusted using a vacuum gauge and a needle valve, and the gas-liquid mixture is subjected to resonance in the resonance bubble-forming device to form fine bubbles. The vacuum cavitation is carried out by using two pumps of the primary pump and the secondary pump, in which the performance of the secondary pump is superior to that of the primary pump, so that an appropriate reduced pressure state is generated.

Even if the performance of the secondary pump is equal to that of the primary pump, the primary pump is affected by the weir effect caused by the ejector, so that the performance of the primary pump becomes lower than that of the secondary pump, whereby an appropriate reduced pressure state is generated.

Primary fine bubbles are generated in the water from the primary pump by the ejector and are transferred to the secondary pump. In the secondary pump, the primary fine bubbles are crushed by vacuum cavitation to the secondary fine bubbles.

Ultra-fine bubbles are generated such that when the primary fine bubbles generated in the resonance ejector have been transferred to the secondary pump under an appropriate reduced pressure state, the primary fine bubbles expand to tens to hundreds of times in the volume. The fine bubbles expanded tens of times are further crushed so as to make them finer by cavitation generated by the high speed rotation of the pump.

The crushed secondary fine bubbles become 1 μm or less in size due to the fact that the primary fine bubbles having the size of 10 μm-500 μm are further crushed by the resonance ejector.

Also, the mechanism of the present invention has advantages such that the size of the pumps can be changed according to the required performance for treatment. The small size pumps are, for example, able to realize the treatment of 10-liter to 20-liter water per minute, and can be easily moved to any site using casters provided thereto. The apparatus having large pumps can treat 1-ton to 10-ton water per minute, which allows the apparatus to be used for environmental cleanup.

DESCRIPTION OF REFERENCE SIGNS

Figure 1:
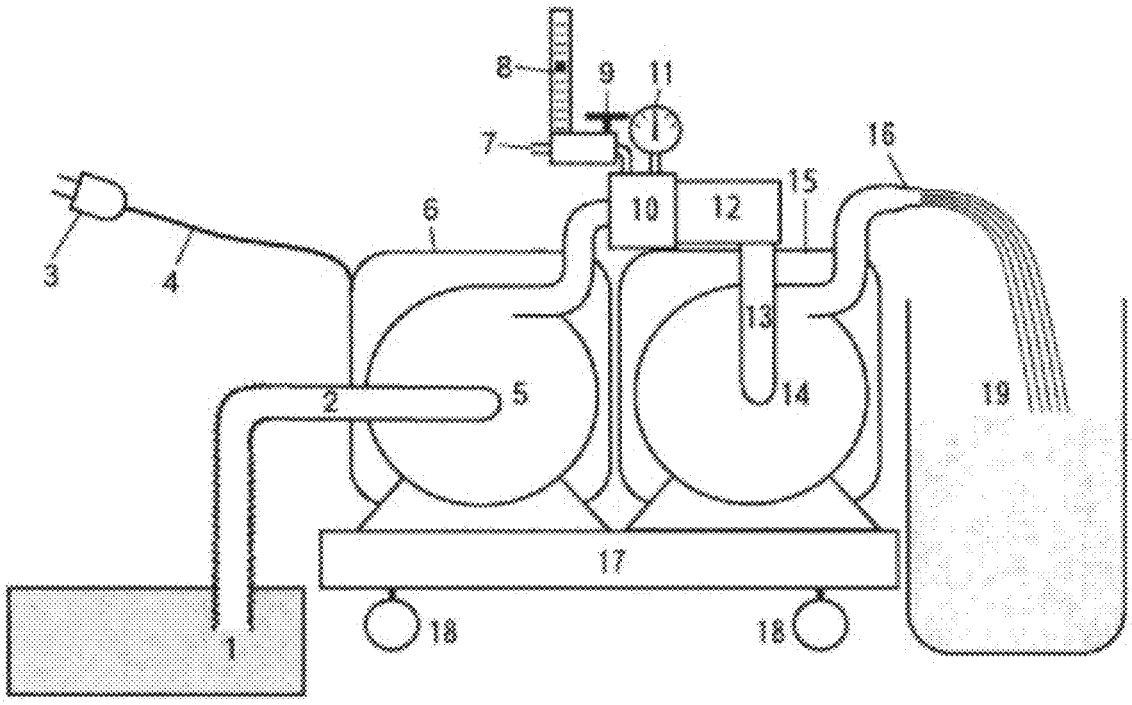
FIG. 1 shows a manufacturing apparatus of ultra-fine air-bubbled water (water including bubbles of air) by resonance bubble-forming and vacuum cavitation.

1. water source
2. suction pipe
3. power source
4. power supply lead wire
5. primary pump
6. primary pump motor
7. inlet port
8. low-pressure flow-gas flowmeter
9. resonance adjustment needle valve
10. resonance ejector
11. resonance adjustment pressure gauge
12. resonance bubble-forming device
13. primary fine-bubbled water supply pipe
14. secondary pump
15. secondary pump motor
16. ultra-fine bubble pressurizing device
17. apparatus support frame
18. caster
19. ultra-fine air-bubbled water storage tank
20. hydrogen gas supply device (hydrogen gas cylinder)
21. main valve
22. gas-pressure meter
23. pressure reducing valve
24. reduced pressure gas meter
25. gas flowmeter
26. gas needle valve

27. gas deodorization filtering device
28. cleaned gas conducting pipe
29. ultra-fine bubble hydrogen water storage tank
30. oxygen supply device (oxygen gas cylinder)
31. ultra-fine oxygen-bubbled water storage tank
32. ozone generation device
33. ultra-fine ozone-bubbled water storage tank
34. nitrogen gas supply device (nitrogen gas cylinder)
35. carbon dioxide gas supply device (carbon dioxide gas cylinder)
36. ultra-fine nitrogen- and/or carbon dioxide-bubbled water storage tank
37. tertiary pump (including successively installed fourth and fifth pipes)
38. tertiary pump motor (including successively installed fourth and fifth pump motors)
40. aspirator air supply device
42. faucet
43. twisted pipe
44. inlet port
45. ventilation switch
47. gas/water separation device
48. water pressure pressurization device
49. injection part A
50. pressurized air vent
52. drain port
60. needle valve
62. pressure gauge
70. resonance ejector
72. resonance device
74. pump
78. double crushing device

DETAILED DESCRIPTION

<Production of Ultra-Fine Air-Bubbled Water by Resonance Bubble-Forming and Vacuum Cavitation>

It is known that dissolved oxygen concentration in water is increased in air-nanosize-bubbled water, so that the water is effective in environmental cleanup. Also, nano-sized fine bubbles are capable of entering into a living body as is, and functions inside the body as an oxygen carrier, which stimulates respiration of the body's cells.

In addition, it is known that the ultra-fine bubbles of air having the size of 1 μm or less activate various enzyme activities in a living body, so as to accelerate the growth of the body, or make the body larger than the usual state of the body.

However, because the ultra-fine air-bubbles facilitate reactivity in oxidation conditions, they promote the growth of cellular tissues, and make the living body grow faster, so that those bubbles accelerate the growth of crops, and increase the yield of crops. It is known that the use of those bubbles increase economic effectiveness in hog raising, poultry farming, or fish farming because use of those bubbles accelerate the growth thereof, which reduces the feed to be fed.

The manufacturing of the ultra-fine air-bubbled water is carried out in the apparatus shown in FIG. 1.

In the apparatus, water is supplied through a suction pipe 2 from a water source 1, electric power is supplied through a power supply lead wire 4 from a power source 3, and air is supplied from an inlet port 7, so that primary fine bubbles are generated at a resonance ejector 10. The generated primary fine bubbles are subjected to vacuum cavitation at a secondary pump 14, so that ultra-fine bubbled water containing secondary fine bubbles is produced.

Operations of the Manufacturing Apparatus of the Ultra-Fine Air-Bubbled Water (1) Water is sucked in from the water source 1 through the suction pipe 2 while the primary pump 5 is operated to suck water.

(2) Sucked water by the operation of the primary pump 5 is transferred to the resonance ejector 10.

(3) Air is sucked from the inlet port 7, and transferred to the resonance ejector 10 through a low-pressure flow-gas flowmeter 8.

(4) Water is jetted out inside the resonance ejector 10, air is mixed into the jetted water in the resonance ejector 10, the air suction side is depressurized, and a resonance adjustment pressure gauge 11 operates.

(5) In the resonance ejector 10, the air taken from the inlet port 7 is adjusted with a resonance adjustment needle valve 9 while each level of the flow and pressure of the air is being checked with the low-pressure flow-gas flowmeter 8 and the resonance adjustment pressure gauge 11, so that the pressure of the air is reduced to the level that fits to resonance bubble-forming of the primary fine bubbles inside a resonance bubble-forming device 12.

(6) The water containing fine bubbles that are generated by the resonance bubble-forming inside the resonance bubble-forming device 12 is transferred to the secondary pump 14 through a water-guide pipe 13.

(7) The secondary pump 14 is provided with higher water discharge capacity than the primary pump 5, so that a reduced pressure state is realized. The level of the reduced pressure in the resonance ejector and the water system including and downstream of the resonance ejector is indicated on the pressure gauge 11.

(8) In the secondary pump 14, the primary fine bubbles generated inside the resonance bubble-forming device 12 expand under the reduced pressure. Moreover, inside the secondary pump 14, a depressurized site, is generated due to the difference between the discharge force of resonance bubble-forming device 12 and the suction force of secondary pump 14, the pressure of the depressurized site corresponding to the water vapor pressure (about 30 torr at 20° C.-30° C.), so that the fine bubbles expand tens of times, and are crushed by vacuum cavitation.

That is, due to the vacuum cavitation under a water vapor pressure, nano-sized fine bubbles are generated.

(9) The nano-sized secondary fine bubbles discharged from the secondary pump 14 are pressurized in a pressurizing device 16, which has a narrowed passage. This process further reduces the size of fine bubbles so as to change the fine bubbles to ultra-fine bubbles, which do not make the water cloudy, and the produced water is clear.

(10) Produced ultra-fine bubbled water is stored in an ultra-fine air-bubbled water storage tank 19, or is distributed through water pipes.

(11) The apparatus is mounted on apparatus support frame 17, and can be moved using casters 18 provided to the frame 17.

(12) Produced ultra-fine air-bubbled water generates oxidative radicals.

<Production of Ultra-Fine Hydrogen-Bubbled Water by Resonance Bubble-Forming and Vacuum Cavitation>

Ultra-fine hydrogen-bubbled water is reductive, and it is said to be effective in the treatment of atopic dermatitis, preventing lifestyle-related diseases including diabetes, and preventing cancer.

Figure 2:
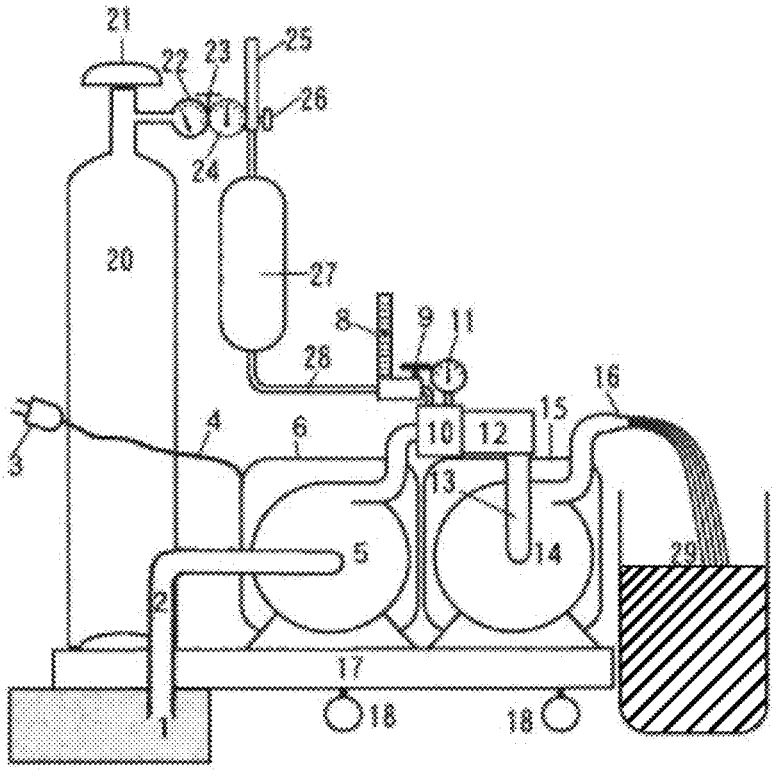
FIG. 2 shows a manufacturing apparatus of ultra-fine hydrogen-bubbled water (water including bubbles of hydrogen gas) by resonance bubble-forming and vacuum cavitation.

The ultra-fine hydrogen-bubbled water is manufactured in the apparatus shown in FIG. 2.

In the apparatus, water is supplied through a water-guide pipe 2 from a water source 1, electric power is supplied through a power supply lead wire 4 from a power source 3, and hydrogen is supplied from a hydrogen supply source 28, so that the primary fine bubbles are produced through resonance bubble-forming by a resonance ejector 10. The generated primary fine bubbles are subjected to vacuum cavitation at a secondary pump 14 so as to be further crushed to generate secondary fine bubbles, whereby ultra-fine hydrogen-bubbled water containing the secondary fine bubbles is manufactured.

Operations of the Manufacturing Apparatus of the Ultra-Fine Hydrogen-Bubbled Water (1) Water is sucked in from the water source 1 through the suction pipe 2 while a primary pump 5 is operated to suck water.

(2) The water sucked by the operation of the primary pump 5 is transferred to the resonance ejector 10 that is provided with a resonance adjustment pressure gauge 11, a low-pressure flow-gas flowmeter 8, a resonance adjustment needle valve 9, and a resonance bubble-forming device 12.

(3) Water is jetted out inside the resonance ejector 10 so that air is mixed into the jetted water in the resonance ejector 10, and the air suction side is depressurized.

(4) Hydrogen gas is supplied from a gas supply device 20. After a main valve 21 has been opened, the gas volume is checked with a gas-pressure meter 22, and the gas pressure is adjusted so as to achieve the target pressure while operating a pressure reducing valve 23 and checking a reduced pressure gas meter 24.

(5) In the gas supply, after the gas pressure is adjusted, the gas flow rate is adjusted by a resonance adjustment gas needle valve 26 while a gas flowmeter 25 is being checked.

(6) The hydrogen gas is passed through a deodorization filtering device 27 that is filled with activated carbon, and is transferred to the resonance ejector 10 that is provided with the resonance adjustment pressure gauge 11, the low-pressure flow-gas flowmeter 8, the resonance adjustment needle valve 9, and the resonance bubble-forming device 12.

(7) In the resonance ejector 10, the gas-liquid swirling in-flow water is shattered, the hydrogen gas pressure level is adjusted by the low-pressure flow-gas flowmeter 8, the resonance adjustment pressure gauge 11, and the resonance adjustment needle valve 9, and resonance bubble-forming of primary fine hydrogen-bubbles (microbubbled hydrogen water) is carried out in a moment inside the resonance bubble-forming device 12.

(8) The microbubbled hydrogen water containing primary hydrogen-gas fine bubbles generated inside the resonance bubble-forming device 12 is transferred to a secondary pump 14 through a water-guide pipe 13.

(9) The secondary pump 14 is provided with higher water discharge capacity than the primary pump 5, so that the pressure is reduced to a vacuum state. The level of the reduced pressure corresponds to that of the water vapor pressure (about 30 torr at 20° C.-30° C.).

(10) In the water system including and downstream of the resonance bubble-forming device 12, the primary fine bubbles generated inside the resonance bubble-forming device 12 expand under the reduced pressure. Moreover, the high-speed rotation of the secondary pump 14 generates a vacuum or a vacuum site, so that the fine hydrogen-bubbles of expand tens of times, and are crushed by vacuum cavitation.

Under this phenomenon, due to the vacuum cavitation under water vapor pressure, nano-sized ultra-fine hydrogen-bubbles (secondary fine bubbles) are generated.

(11) The nano-sized secondary fine hydrogen-bubbles discharged from the secondary pump 14 are pressurized and crushed in pressurizing device 16, which has a narrowed passage. This process further reduces the size of fine bubbles so as to change the fine bubbles to ultra-fine hydrogen-bubbles, which do not make the water cloudy, and the produced water is clear.

(12) Produced ultra-fine hydrogen-bubbled water is stored in a prescribed storage tank 29, or is distributed through water pipes.

(13) The apparatus is mounted on an apparatus support frame 17, and can be moved using casters 18 provided to the frame 17.

(14) Produced ultra-fine hydrogen-bubbled water generates reductive radicals.

<Production of Ultra-Fine Oxygen-Bubbled Water by Resonance Bubble-Forming and Vacuum Cavitation>

Figure 3:
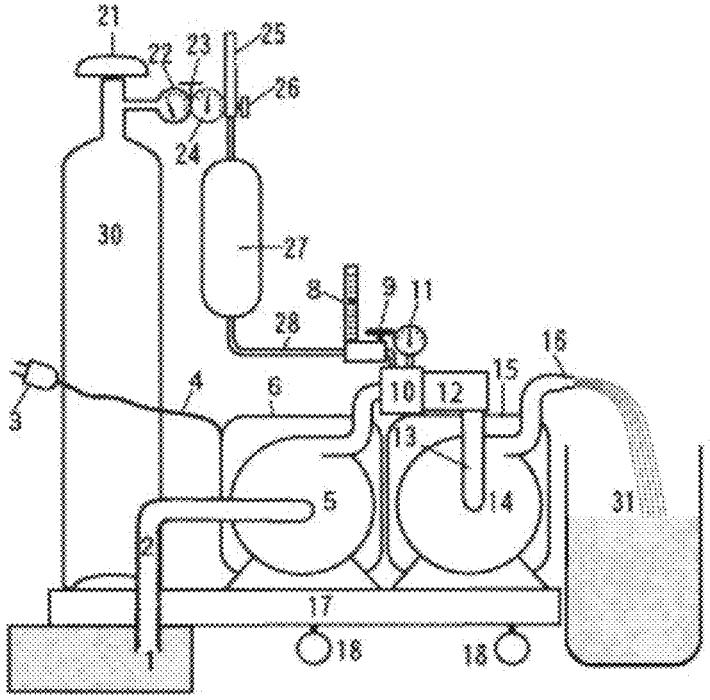
FIG. 3 shows a manufacturing apparatus of ultra-fine oxygen-bubbled water (water including bubbles of oxygen gas) by resonance bubble-forming and vacuum cavitation.

Fine oxygen-bubbled water is needed in the care of moribund patients, who need oxygen inhalation. Also, oxygen nanobubbles having the size of 1 μm or less generate hydroxy radicals within a living body, and increase metabolism activities including enzyme activities. The manufacturing of ultra-fine oxygen-bubbled water is carried out in the apparatus shown in FIG. 3.

In the apparatus, water is supplied through a water-guide pipe 2 from a water source 1, electric power is supplied through a power supply lead wire 4 from a power source 3, and oxygen is supplied from an oxygen supply source 18, so that the primary fine bubbles are produced through resonance bubble-forming by a resonance ejector 10. The generated primary fine bubbles are subjected to vacuum cavitation at a secondary pump 14 so as to be further crushed to generate secondary fine bubbles, so that ultra-fine oxygen-bubbled water containing secondary fine oxygen-bubbles is produced.

Operations of the Manufacturing Apparatus of the Ultra-Fine Oxygen-Bubbled Water (1) Water is sucked in from a water source 1 through a suction pipe 2 while a primary pump 5 is operated to suck water.

(2) The water sucked by the operation of the primary pump 5 is transferred to the resonance ejector 10 that is provided with a resonance adjustment pressure gauge 11, a low-pressure flow-gas flowmeter 8, a resonance adjustment needle valve 9, and a resonance bubble-forming device 12.

(3) Water is jetted out inside the resonance ejector 10, so that air is mixed into the jetted water in the resonance ejector 10, and the air suction side is depressurized.

(4) Oxygen gas is supplied from a gas supply device 30. After a main valve 21 has been opened, the gas volume is checked with a gas-pressure meter 22, and the gas pressure is adjusted so as to achieve the target pressure while operating a pressure reducing valve 23 and checking a reduced pressure gas meter 24.

(5) In the gas supply, after the gas pressure is adjusted, the gas flow rate is adjusted with a resonance adjustment gas needle valve 26 while a gas flowmeter 25 is being checked.

(6) The oxygen gas is passed through a deodorization filtering device 27 that is filled with activated carbon, and is transferred to the resonance ejector 10 that is provided with the resonance adjustment pressure gauge 11, the low-pressure flow-gas flowmeter 8, the resonance adjustment needle valve 9, and the resonance bubble-forming device 12.

(7) In the resonance ejector 10, the gas-liquid swirling in-flow water is shattered, the hydrogen gas pressure level is adjusted by the low pressure flow gas flowmeter 8, the resonance adjustment pressure gauge 11, and the resonance adjustment needle valve 9, and resonance bubble-forming of primary fine oxygen-bubbles (microbubbled oxygen water) is performed in a moment inside the resonance bubble-forming device 12.

(8) The water containing primary fine oxygen-bubbles generated inside the resonance bubble-forming device 12 is transferred to a secondary pump 14 through a water-guide pipe 13.

(9) The secondary pump 14 is provided with higher water discharge capacity than the primary pump 5, so that the pressure is reduced to a vacuum state. The reduced pressure corresponds to the water vapor pressure (about 30 torr at 20° C.-30° C.).

(10) In the secondary pump 14, the primary fine bubbles generated inside the resonance bubble-forming device 12 expand under the reduced pressure. Moreover, the high-speed rotation of the secondary pump 14 generates a reduced pressure vacuum site, so that the fine oxygen-bubbles expand tens of times, and are crushed by vacuum cavitation.

(11) The nano-sized fine oxygen-bubbles discharged from the secondary pump 14 are pressurized in a pressurizing device 16, which has a narrowed passage. This process further reduces the size of the fine bubbles, and those fine bubbles float in water.

(12) Produced ultra-fine oxygen-bubbled water is stored in a predetermined storage tank 29, or is distributed through water pipes.

(13) The apparatus is mounted on an apparatus support frame 17, and can be moved using casters 18 provided to the frame 17.

(14) Produced ultra-fine bubble oxygen water generates oxidative radicals.

<Production of Ultra-Fine Ozone-Bubbled Water by Resonance Bubble-Forming and Vacuum Cavitation>

Ozone's oxidation-reduction potential is 2070 mV, and ozone in a gas state is very dangerous. If ozone exists in the form of ozone-nanosize-bubbled water, the ozone can be used safely without so much damage to human bodies caused by, for example, inhaling ozone. Because of ozone's bactericidal/antibacterial activities, it is said that ozone is used for disinfection of a hospital room and external disinfection of a living body instead of strong chemicals.

Figure 4:
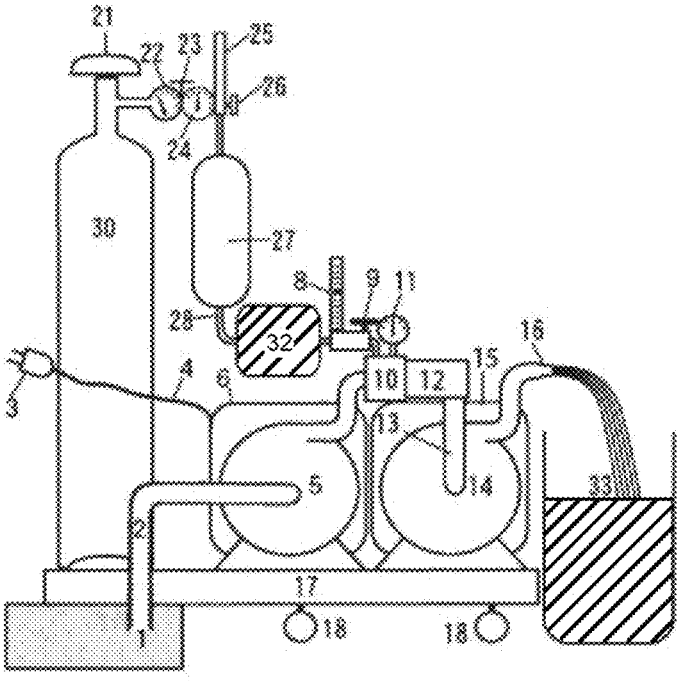
FIG. 4 shows ultra-fine ozone-bubbled water (water including bubbles of ozone gas) manufacturing apparatus by resonance bubble-forming and vacuum cavitation.

The manufacturing of ozone-nanobubbled water is carried out in the apparatus shown in FIG. 4.

In the apparatus, water is supplied through a water-guide pipe 2 from a water source 1, and electric power is supplied through a power supply lead wire 4 from a power source 3. Regarding ultra-fine ozone-bubbled water, ozone is made in an ozone generation device 32 using oxygen supplied from an oxygen supply source 16, and then the generated ozone is transformed into primary ozone-microbubbles by an ejector ozone. The generated primary ozone-microbubbles are subjected to vacuum cavitation at a secondary pump to crush into the ultra-fine ozone-bubbled water.

Operations of the Manufacturing Apparatus of the Ultra-Fine Ozone-Bubbled Water (1) Water is sucked in from a water source 1 through a suction pipe 2 while a primary pump 5 is operated to suck water.

(2) The water sucked by the operation of the primary pump 5 is transferred to the ejector 10.

(3) Water is jetted out inside the ejector 10, and is depressurized.

(4) Oxygen gas is supplied from a gas supply device 30. After a main valve 21 has been opened, the gas volume is checked with a gas-pressure meter 22, and the gas pressure is adjusted so as to achieve the target pressure while operating a pressure reducing valve 23 and checking a reduced pressure gas meter 24.

(5) After the gas pressure is adjusted, the gas flow rate is adjusted with a resonance adjustment gas needle valve 26 while a gas flowmeter 25 is being checked.

(6) The oxygen gas whose flowrate has been adjusted is passed through a deodorization filtering device 27 that is filled with activated carbon and an ozone generation device 32, and is transferred to a resonance ejector 10 that is provided with a resonance adjustment pressure gauge 11, a low pressure flow gas flowmeter 8, a resonance adjustment needle valve 9, and a resonance bubble-forming device 12.

(7) In the resonance ejector 10, the gas-liquid swirling in-flow water is shattered, the hydrogen gas pressure level is adjusted with the low pressure flow gas flowmeter 8, the resonance adjustment pressure gauge 11, and the resonance adjustment needle valve 9, and resonance bubble-forming of primary fine ozone-bubbles (ozone-microbubbled water) is carried out in a moment inside the resonance bubble-forming device 12.

(8) The ozone-microbubbled water that is produced inside the resonance bubble-forming device 12 is transferred to a secondary pump 14 through a water-guide pipe 13.

(9) The secondary pump 14 is provided with higher water discharge capacity than the primary pump 5, so that the pressure is reduced. The level of the reduced pressure is indicated on a reduced pressure gauge meter 11.

(10) In the water system including and downstream of the resonance bubble-forming device 12, the primary fine ozone-bubbles generated inside the resonance bubble-forming device 12 is sucked by the rotation of the secondary pump 14 to generate a vacuum site, so that the microbubbles of ozone expand tens of times, and are crushed by vacuum cavitation generated by the high-speed rotation of the secondary pump 14. Under this phenomenon, due to the vacuum cavitation under water vapor pressure, nano-sized ultra-fine ozone-bubbles of (secondary fine ozone-bubbles) are generated.

(11) The ultra-fine ozone-bubbled water discharged from the secondary pump 14 has not been cloudy anymore, and then is pressurized to be crushed in a pressurizing device 16, which has a narrowed passage. This process further reduces the size of the fine bubbles.

(12) Produced ultra-fine ozone-bubbled water is stored in a predetermined storage tank 33, or is distributed through water pipes.

(13) The apparatus is mounted on an apparatus support frame 17, and can be moved using casters 18 provided to the frame 17.

<Production of Ultra-Fine Bubbled-Water of Nitrogen Gas, or Carbon Dioxide Gas, or the Mixture Thereof by Resonance Bubble-Forming and Vacuum Cavitation>

Figure 5:
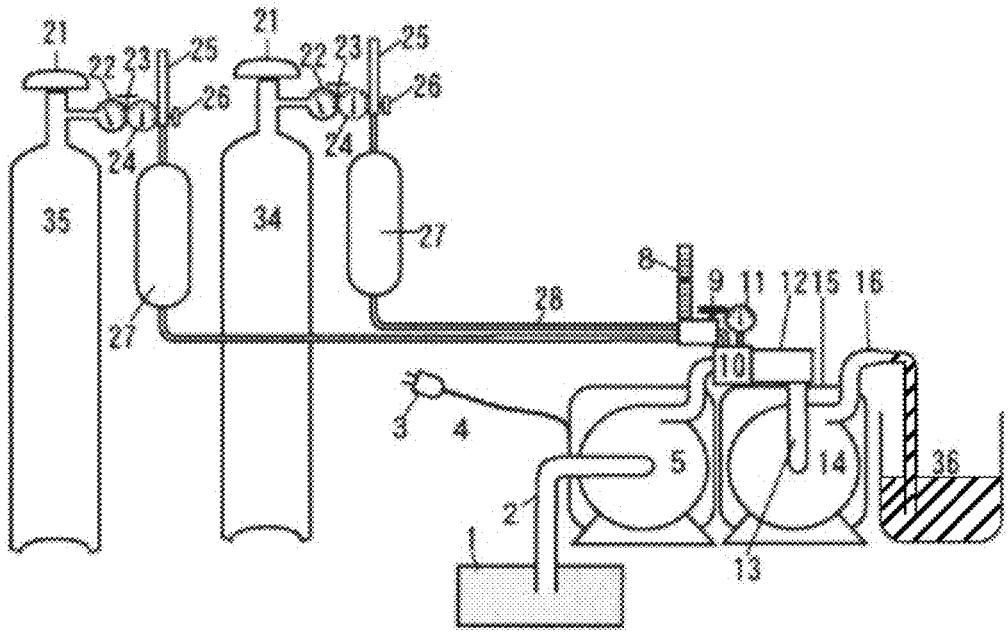
FIG. 5 shows ultra-fine nitrogen-bubbled water (water including bubbles of nitrogen gas) manufacturing apparatus of gas and/or carbon dioxide gas by resonance bubble-forming and vacuum cavitation.

In order for keeping freshness of vegetables, meat, fish, or for transporting them over a long distance, it is effective to use fine nitrogen-, carbon dioxide- or the mixture thereof-bubbled water along with cooling them. The fine-bubbled water containing such gas makes it possible to transport a living body in the state of their having a nap, or in asphyxia, so that the deterioration of freshness thereof is prevented. Manufacturing of fine bubbled-water of nitrogen gas, or carbon dioxide gas, or the mixture thereof is carried out in the apparatus shown in FIG. 5.

In the apparatus, water is supplied through a water-guide pipe 2 from a water source 1, electric power is supplied through a power supply lead wire 4 from a power source 3, and nitrogen gas is supplied from a nitrogen supply source 34, or carbon dioxide gas is supplied from a carbon dioxide supply source 34, so that primary fine nitrogen-microbubbled water or carbon dioxide-microbubbled water is produced at a resonance ejector by primary bubble-forming.

The generated primary fine bubbles are subjected to vacuum cavitation in a secondary pump to carry out secondary bubble-forming, whereby ultra-fine nitrogen-bubbled water, ultra-fine carbon dioxide-bubbled water, or ultra-fine nitrogen gas and carbon dioxide mixed gas-bubbled water containing the secondary fine bubbles is produced.

Operations of the Manufacturing Apparatus of the Ultra-Fine Bubbled Water of Nitrogen Gas and/or Carbon Dioxide Gas (1) Water is sucked in from a water source 1 through a suction pipe 2 while a primary pump 5 is operated to suck water.

(2) The water sucked by the operation of the primary pump 5 is transferred to the resonance ejector 10 that is provided with a resonance adjustment pressure gauge 11, a low-pressure flow-gas flowmeter 8, a resonance adjustment needle valve 9, and a resonance bubble-forming device 12.

(3) Water is jetted out inside the resonance ejector 10, air is mixed into the jetted water in the resonance ejector 10, and the air suction side is depressurized.

(4) Nitrogen gas, carbon dioxide gas, or the mixture thereof is supplied from a nitrogen gas supply device 34 and/or a carbon dioxide gas supply device 35. After a main valve 21 has been opened, the gas volume is checked by a gas-pressure meter 22, and the gas pressure is adjusted so as to achieve the predetermined pressure while operating a pressure reducing valve 23 and checking a reduced pressure gas meter 24.

(5) After the gas pressure is adjusted, the gas flow rate is adjusted with a resonance adjustment gas needle valve 26 while a gas flowmeter 25 is being checked.

(6) The nitrogen gas, carbon dioxide gas, or the mixture thereof is passed through a deodorization filtering device 27 that is filled with activated carbon, and is transferred to the resonance ejector 10 that is provided with the resonance adjustment pressure gauge 11, the low pressure flow gas flowmeter 8, the resonance adjustment needle valve 9, and the resonance bubble-forming device 12.

(7) In the resonance ejector 10, the gas-liquid swirling in-flow water is shattered, the hydrogen gas pressure level is adjusted with the low-pressure flow-gas flowmeter 8, the resonance adjustment pressure gauge 11, and the resonance adjustment needle valve 9, and resonance bubble-forming of primary fine bubbles (microbubbles) of nitrogen gas and/or carbon dioxide gas is carried out in a moment inside the resonance bubble-forming device 12.

(8) The water containing primary fine bubbles of nitrogen gas and/or carbon dioxide gas generated inside the resonance bubble-forming device 12 is transferred to a secondary pump 14 through a water-guide pipe 13.

(9) The secondary pump 14 is provided with higher water discharge capacity than the primary pump 5, so that the pressure is reduced to a vacuum state. The level of the reduced pressure corresponds to the level of the water vapor pressure (about 30 torr at 20° C.-30° C.).

(10) In the secondary pump 14, the primary fine bubbles generated inside the resonance bubble-forming device 12 expand under the reduced pressure. Moreover, the high-speed rotation of the secondary pump 14 generates a vacuum or a vacuum site, so that the fine bubbles expand tens of times, and are crushed by vacuum cavitation. Under this phenomenon, due to the vacuum cavitation under water vapor pressure, nano-sized ultra-fine bubbles of nitrogen gas and/or carbon dioxide gas (secondary fine bubbles) are generated.

(11) The nano-sized secondary fine bubbles of nitrogen gas and/or carbon dioxide gas discharged from the secondary pump 14 are pressurized and crushed in a pressurizing device 16, which has a narrowed passage. This process further reduces the size of fine bubbles so as to change the fine bubbles to ultra-fine bubbles, which do not make the water, and the produced water is clear.

(12) Produced ultra-fine bubble nitrogen water, ultra-fine bubble carbon dioxide gas water, or ultra-fine bubble nitrogen and carbon dioxide gas is stored in a predetermined storage tank 29, or is distributed through water pipes.

(13) The apparatus is mounted on an apparatus support frame 17, and can be moved using casters 18 provided to the frame 17.

<Production of Ultra-Fine Bubbled Water by Multistage Resonance Bubble-Forming and Vacuum Cavitation>

It is expected that the academic and business areas including medicine, zoology, botany, life science, inorganic chemistry, electronics, atomic physics, various manufacturing operations, and cleaning business will need further finer fine bubbles in the future. Based on this assumption, the technologies to shred fine bubbles so as to make the fine bubbles smaller will be proposed below.

Figure 6:
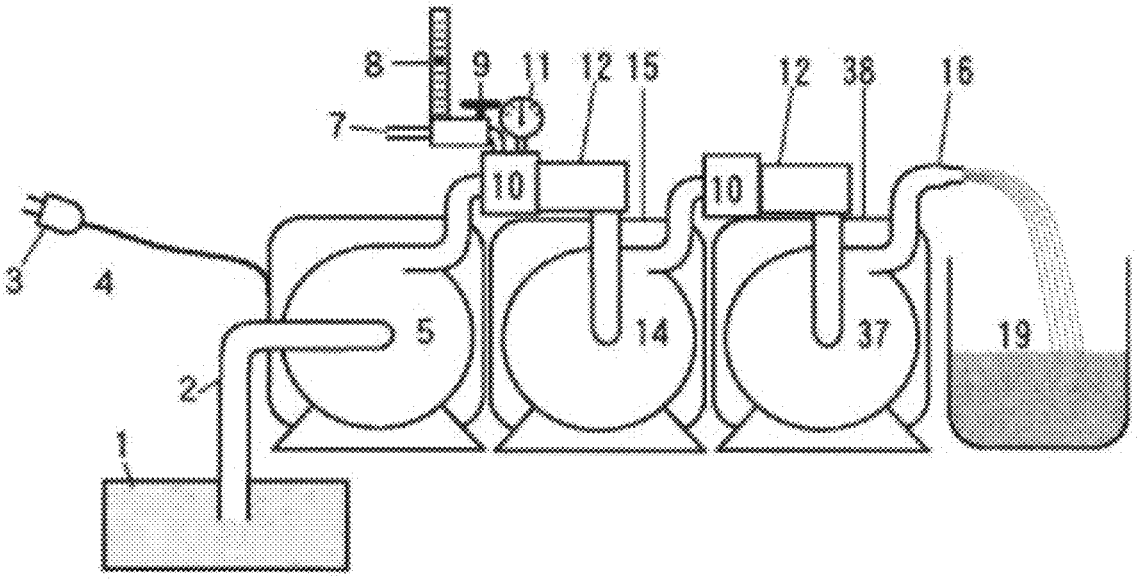
FIG. 6 shows fine-bubbled water manufacturing apparatus by multistage resonance bubble-forming and multistage vacuum cavitation.

Multistage resonance bubble-forming and vacuum cavitation apparatus is shown in FIG. 6, in which the apparatus employing resonance bubble-forming technology and vacuum cavitation pump is added to the ultra-fine bubble manufacturing apparatus using air, hydrogen, oxygen, ozone, nitrogen gas, carbon dioxide gas by resonance bubble-forming and vacuum cavitation.

Ultra-Fine Bubbled Water Manufacturing Apparatus by Multistage Resonance Bubble-Forming and Vacuum Cavitation This apparatus has basically the same structure as the apparatus disclosed above at the front part of the apparatus, that is, that uses various gases.

For any gas mentioned above, the apparatus has some parts of basically the same structure as the apparatus disclosed above, i.e., from the primary pump 5 that supplies sucked water from the water source to the secondary pump: that is, they includes a pipe 28 that supplies a variety of gases, a resonance ejector 10 in which water discharged from the primary pump is mixed with the variety of gases and the water containing the gases is depressurized, the ejector 10 is provided with a resonance adjustment pressure gauge 11, a low pressure flow gas flowmeter 8, a resonance adjustment needle valve 9, and a resonance bubble-forming device 12. Further, fine bubbles formed by resonance bubble-forming are crushed in a secondary pump by vacuum cavitation.

A resonance bubble-forming device and a tertiary pump 37 are installed behind the secondary pump, which can generate smaller ultra-fine bubbles by vacuum cavitation. If necessary, fourth, fifth, and the other additional pumps can be installed so as to generate finer bubbles further, which will meet the future needs for ultra-fine bubbles.

Effects of Invention

The technique and apparatus according to the present invention provide the following effects.

The dissolved oxygen concentration is increased in the ultra-fine air-bubbled water to generate oxidative radicals, so that the oxidative water is effective in environmental cleanup.

Also, the nano-sized fine bubbles can enter into a living body as is, so that the fine bubbles function as a carrier of oxygen so as to ease respiration of the body's cells due to oxidative radicals.

Oxidative radicals promote enzyme activities within a living body, which facilitates growth of the living body.

Ultra-fine hydrogen-bubbled water exhibits reductive activities and generates anti-oxidative radicals, so that the water can be effective in treatment of atopic dermatitis, and in prevention of lifestyle-related diseases including diabetes and cancer.

Ozone's oxidation-reduction potential is 2070 mV, and therefore if ozone exists in the form of gas, ozone is very dangerous. Ozone in the form of ozone-nanosize-bubbled water is used safely without damage to human bodies caused by, for example, inhaling ozone.

Because of ozone's bactericidal/antibacterial activities, ozone is used for disinfection of a hospital room and external disinfection of a living body instead of strong chemicals. The ultra-fine bubbled water of nitrogen and/or carbon dioxide gas is used for keeping freshness of perishable foods.

In order for keeping freshness of vegetables, meat, fish, when, for example, they are transported over a long distance, use of fine-bubbled water of nitrogen gas, or carbon dioxide gas, or the mixture thereof along with cooling the products is needed.

The fine-bubbled water containing such a gas makes it possible to transport a living body in the state of their having a nap, or in asphyxia, so that the deterioration of freshness thereof is prevented.

EXAMPLES

Configurations and functions of the apparatus provided by the present invention will be explained in conjunction with the experimental studies conducted for the embodiments of the invention.

Example 1 how the Difference of the Treatments for Generating Fine Bubbles by Using Crushing of Air, Resonance Bubble-Forming, and Vacuum Cavitation Affects the Gas Dissolution Rate and the Cloudiness in Terms of the Liquids to which Each Treatment is Applied Purpose of the Experiment Previous studies on fine bubbles generation have been carried out based on the idea that air and liquid are mixed, the mixture of the air and liquid is sheared so as to form fine bubbles, and the afore-said process to generate fine bubbles is repeated. The technologies of bubble forming by shearing has been developed in line with this idea, and the emphasis of the technology development has been placed on developing efficient methods of shearing to generate bubbles.

This experimentation has demonstrated the effectiveness of the method of the present invention that uses resonance bubble-forming and vacuum cavitation in manufacturing fine bubbles, which are finer than those made by prior art. The present invention includes the following features such that the resonance caused by the processes of depressurizing and pressurizing the mixture of the air and liquid as well as shearing thereof promote to generate uniform-sized bubbles; the bubbles first generated are subjected to a vacuum, so that the bubbles expand; and the expanded bubbles are crushed by vacuum cavitation whereby the bubbles become finer.

1) Test Method

The following three methods were used to comparatively study the state of gas dissolution in water.

Figure 7:
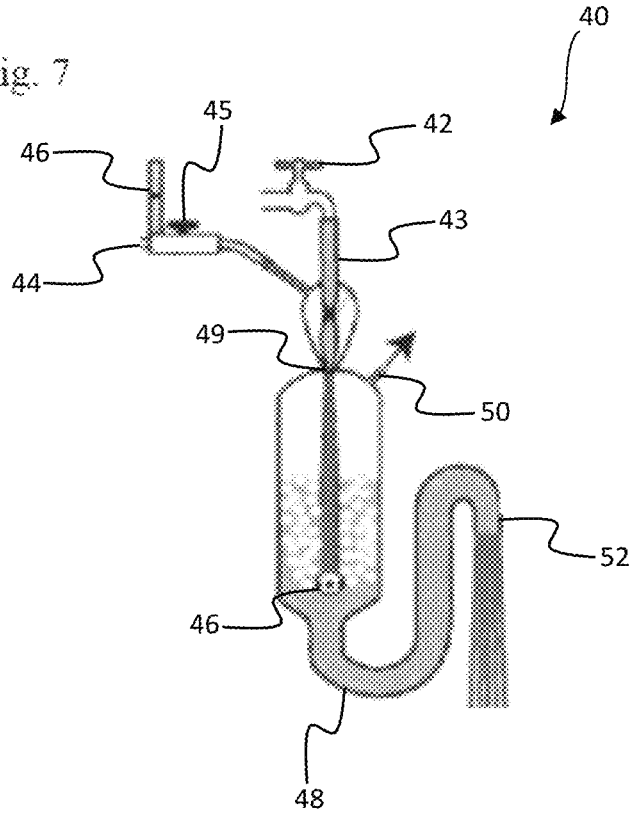
FIG. 7 shows the operations by the method of shearing and crushing using an aspirator air supply device.
Figure 8:
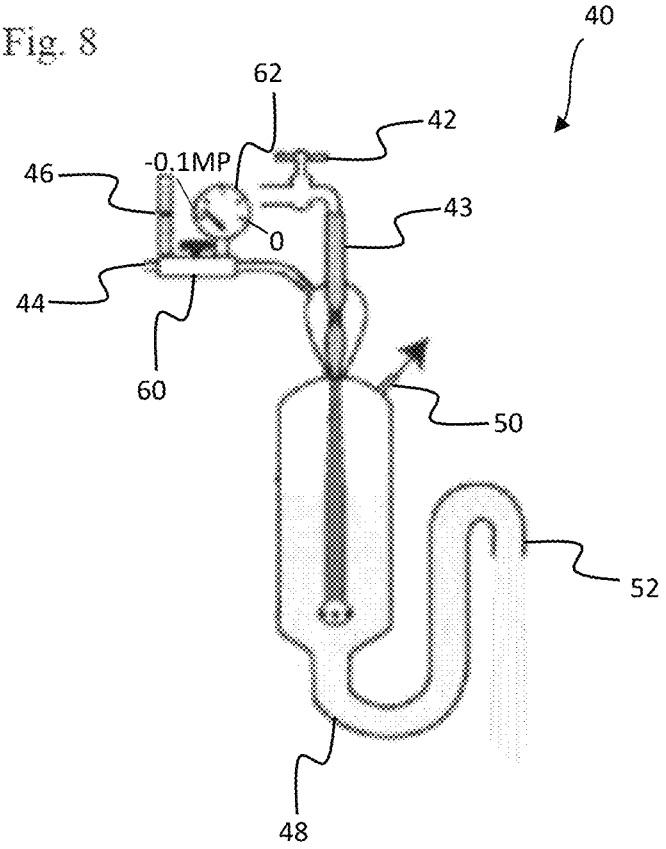
FIG. 8 shows the operations by the method of depressurized resonance bubble-forming using an aspirator air supply device.
Figure 9:
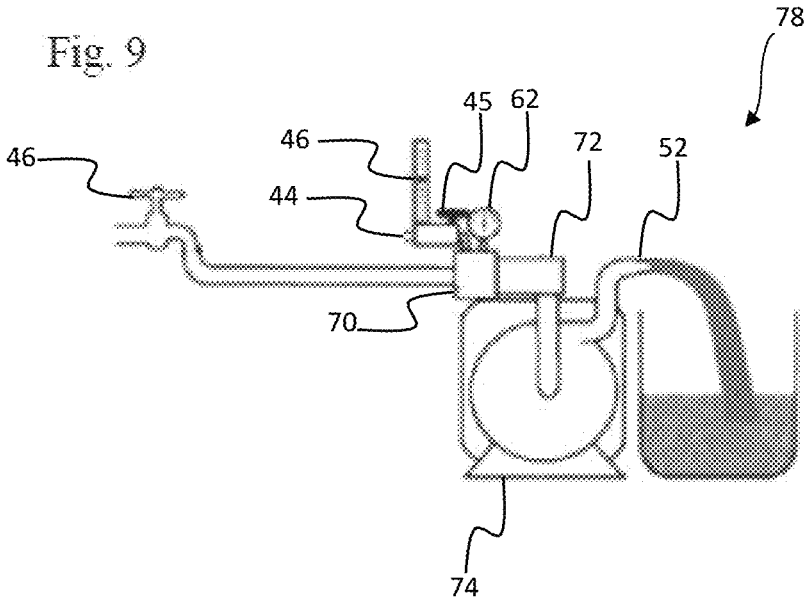
FIG. 9 shows the operations by the method of double crushing using depressured resonance bubble-forming and vacuum cavitation crushing.

(1) Shearing and Crushing by Aspirator (2) Depressurized resonance bubble-forming (3) Double crushing by depressurized resonance bubble-forming and vacuum cavitation 2) Outline of Each Device Used Each structure of the devices used for the methods of shearing and crushing, depressurized resonance bubble-forming, and vacuum cavitation is shown in FIGS. 7-9. In each device, a water faucet of tap water was used so as to perform the function of a primary pump, shearing and crushing were carried out by an aspirator, and depressurized resonance bubble-forming, and double crushing by depressurized resonance bubble-forming and vacuum cavitation were carried out. The pump used for double crushing in the vacuum cavitation corresponds to the secondary pump of the present invention.

FIG. 7 shows a shearing and crushing method by an aspirator air supply device 40. In the shearing and crushing method, bubbles are crushed by gas-liquid swirling crushing of an aspirator. The device is provided with an aspirator and a gas/water separation device. Tap water jets out from a faucet 42 through a twisted pipe 43 due to the function of an aspirator, which allows air to be sucked from an inlet port 44 through a ventilation switch 45. Additionally, the inlet port 44 and ventilation switch 45 include a gas flowmeter 46. The sucked air becomes large bubbles in a gas/water separation device 47, and the bubbles are sent out from the device by a water pressure pressurizing device 48.

When air is sucked from the inlet port, and is jetted out from an injection part due to this jet of the water, shearing of air occurs at the injection part A 49, and fine bubbles of large and small sizes flow out from the drain port of the injection part A 49. This is one of the methods of shearing of air to be used along with cavitation when manufacturing fine bubbles. Gas-liquid shearing and crushing by cavitation generated by a high-speed stirring device can also generate similar fine bubbles.

The shearing and crushing method is used in manufacturing microbubbles in many cases. In this method, the size of the generated bubbles does not become uniform, so that water is repeatedly passed through a crushing device so as to accumulate similar-sized fine bubbles.

As shown in FIG. 7, water from the faucet 42 passes through a twisted pipe 43 which causes gas-liquid swirling. The gas liquid swirling in the twisted pipe 43 generates an injection of fine bubbles due to a reduced pressure. But most of the air from the gas/water separation device 47 becomes large bubbles to be floated out of the water. These large bubbles are sent out of the device as pressurized air through the pressurized air vent 50. The aspirator air supply device 40 shown in FIG. 7 additionally includes a water pressure pressurization device 48 having a drain port 52. The water exiting the drain port 52 is a flow of water containing a small quantity of fine bubbles.

FIG. 8 shows a depressurized resonance bubble-forming method by an aspirator air supply device. In performing depressurized resonance bubble-forming, a needle valve 60 and a pressure gauge 62 are mounted on the suction part of the device; the sucked air is depressurized, so that a gas/water separation device acquires a function of a resonance device; a resonance occurs, like a pipe is blown, based on the volume of jetting-out water, depressurized supply air, and the conditions of a water pressure pressurizing part; and almost all the sucked air becomes bubbles in a moment throughout an entire resonance device to make the water cloudy. Dispersed bubbles that make the water cloudy are uniform-sized microbubbles. Uniform-sized microbubbles are formed due to the generation of a resonance sound by the air under a reduced pressure state and adjustment of conditions at water pressure pressurization part 48.

FIG. 9 shows a double crushing method in which the depressurized resonance bubble-forming method of FIG. 8 (utilizing a resonance ejector 70 and resonance device 72) and a vacuum cavitation are carried out by the same double crushing device 78. After uniform-sized bubbles have been formed, the vacuum cavitation is carried out by using a pump 74 that sucks more larger volume of water than the water volume supplied from the resonance device.

The water discharged after the double crushing method has been carried out contain a large quantity of gas, but the water is colorless and transparent without becoming cloudy.

Normally, the microbubbles of 1 μm-200 μm cause a Tyndall phenomenon, so that diffused reflection of light occurs, which makes water cloudy. However, it is known that nano-sized fine bubbles having the size of 1 μm or less do not cause the diffused reflection of light, and does not make water cloudy.

3) Measuring method: A flow meter of water, a precision flow meter of gas, a pressure gauge, and a 1 liter measuring cylinder are used to collect and measure remaining gas, and observe the cloudiness of water.

The flow rate of the tap water used was 30 liters per minute.

Points in Measuring (1) When the shearing and crushing of the aspirator in FIG. 7 was carried out, the flow rate of water, the flow rate of injected air, and the volume of collected gas were measured.

(2) When the depressurized resonance bubble-forming shown in FIG. 8 was carried out, the flow rate of water, the flow rate of injected air, and the volume of collected gas were measured.

(3) When the depressurized resonance bubble-forming and vacuum cavitation crushing were carried out, the flow rate of water, the flow rate of injected air, and the volume of collected gas were measured.

The aspirator and the pressurizing device were made of glass so that the change of water conditions was observed.

4) Test Results

The measurement results are shown in Table 1.

TABLE 1

Comparison between treatment methods of shearing and crushing, resonance bubble-forming, and resonance bubble-forming and vacuum cavitation

| Test parameters | Shearing and crushing | Resonance bubble-forming | Resonance bubble-forming and vacuum cavitation |
|---|---|---|---|
| Water flow rate (L/min) | 00.0 | 9.0 | 9.0 |
| Gas injection volume (ml/min) | 2,000 | 1,000 | 1,000 |
| Undissolved gas volume (ml/min) | 1,800 | 300 | 300 |

TABLE 1-continued

Comparison between treatment methods of shearing and crushing, resonance bubble-forming, and resonance bubble-forming and vacuum cavitation

| Test parameters | Shearing and crushing | Resonance bubble-forming | Resonance bubble-forming and vacuum cavitation |
|---|---|---|---|
| Dissolved gas volume (ml/min) | 200 | 700 | 700 |
| Additive gas ratio (volume %) | 2.0 | 7.7 | 7.7 |
| Gas dissolution rate (volume %) | 2.5-3.8 | 9.2-9.5 | 9.2-9.5 |
| Depressurization at injection part A | −0.01 MPa | −0.09 MPa | −0.09 MPa |
| Cloudiness level of water | Half cloudy | Completely cloudy | Colorless and transparent |

Outline of Results

Although the flow rate of tap water was 30 liters per minute, the flow rate was decreased to 10 liters per minute when the water passed through the aspirator because the aspirator functioned as a weir. When the water was depressurized and was subjected to resonance, the flow rate was further decreased to 9 liters per minute.

In case that the shearing and crushing method was used, two liters of air was sucked into the water having the flow rate of 10 liters per minute, 1.8 liters of air was discharged out from the water system as large bubbles, and 200 milliliters of air remained in the water as fine bubbles. Because the volume ratio of air contained in usual water of 20° C.-25° C. is 1.5%-1.8%, the dissolved gas ratio (volume %) was 2.5%-3.8%. The depressurization at the injection part A at this time was about −0.01 MPa. The cloudiness level of water was half cloudy, and the size of the fine bubbles was not uniform. Therefore, it was found that the water needed to be subjected to circulation treatment so as to accumulate fine bubbles.

In case that the resonance bubble-forming method was used, the water passing through the aspirator was depressurized using the pressure gauge and the needle valve, and the water jetting out of the aspirator was pressurized at the resonance device, where the water flow rate had been decreased to 9 liters per minute. When the volume of the air sucked into the jet water was adjusted to 1 liter per minute, the depressurization at the injection part A was adjusted to −0.09 MPa, and the liquid was subjected to resonance, so that the entire liquid became cloudy, and large amounts of microbubbles were formed in a moment. About 300 milliliters of air were discharged out of the water system as large bubbles, and 700 milliliters of the air remained in the water as fine bubbles. Accordingly, the dissolved gas ratio (volume %) including fine bubbles contained in the water was 9.2%-9.5%, and the liquid became cloudy due to light scattering caused by a Tyndall phenomenon.

In case that both the resonance bubble-forming method and vacuum cavitation method were used, the process of the resonance bubble-forming generated the same results as those generated by the above-described resonance bubble-forming device, but adding the vacuum cavitation made the fine bubbles finer, so that the light scattering caused by the Tyndall phenomenon did not occur, and the liquid became colorless and transparent. It is known that if the size of fine bubbles is 1 μm or less, light scattering caused by the Tyndall phenomenon does not occur, and the liquid containing the fine bubbles become colorless and transparent.

The test in this Example was conducted to demonstrate the differences in the mechanism and the generated nanobubbles between the present invention and the inventions of prior art. In the actual implementation of the present invention, as is shown in FIGS. 1-6, a secondary pump is connected to a primary pump, and a resonance bubble-forming device is installed between the two pumps, so that microbubbles are generated by resonance bubble-forming, and generated bubbles are made finer by vacuum cavitation that is generated by the difference in the water suction capabilities between the primary pump and the secondary pump.

Example 2 Study on Ultra-Fine Bubble Generation Volume of Air and the Size of Bubbles 1) Test Method (1) Ultra-fine bubble device: Vacuum cavitation ultra-fine bubble generation device of the present invention (2) Measuring method: Measurement of the intensity of light scattering by a Tyndall phenomenon Green beam was irradiated to a cell container in which ultra-fine bubbled water was filled, and the intensity of the green light scattering was measured as shown in Table 2. This method was capable of measuring the intensity of the light scattering according to the densities of the ultra-fine bubbles having the size of 100 nm or less.

2) Test Results

Figure 10:
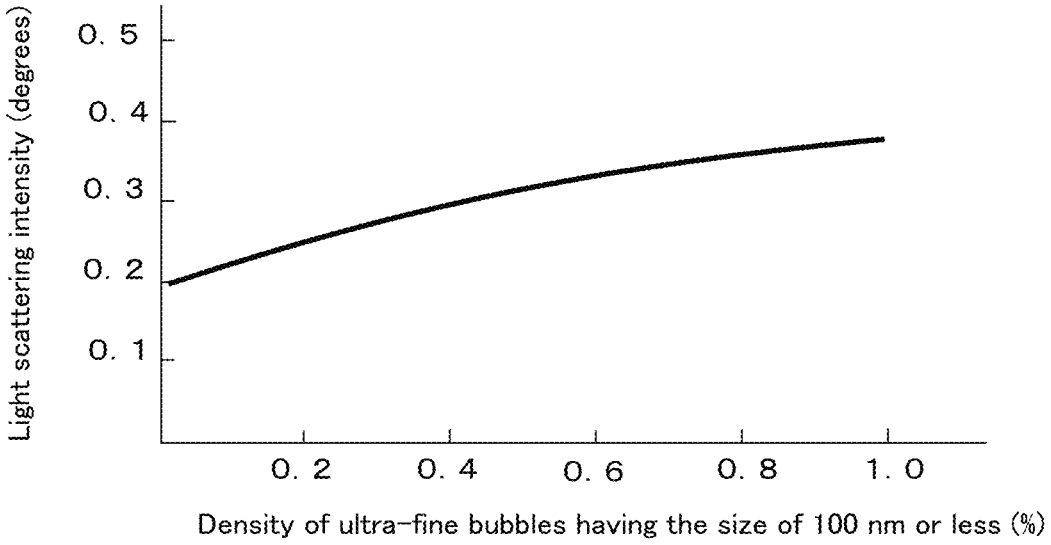
FIG. 10 is a table showing the relationship between the density of ultra-fine bubbles and the intensity of light scattering by irradiation of a green laser beam.

Test results are shown in FIG. 10. FIG. 10 shows the relationship between the density of ultra-fine bubbles and the intensity of light scattering by irradiation of a green laser beam.

3) Outline of Results

As the density of ultra-fine bubbles increased, the intensity of light scattering increased, and therefore generation of large quantity of ultra-fine bubbles having the size of 100 μm or less were confirmed in this device. However, the size distribution of the ultra-fine bubbles was not confirmed.

Example 3 Study on Manufacturing of Ultra-Fine Bubble Hydrogen Water and the Change of Properties of Water Studied was the oxidation-reduction potential of the ultra-fine bubble hydrogen water that was produced from tap water by using the above-described ultra-fine bubble hydrogen water manufacture and supply apparatus. A comparative study was made by comparing each oxidation-reduction potential of tap water, reductive hydrogen water made such that hydrogen gas was blown into water and the water was subjected to cavitation so that the hydrogen gas was absorbed by the water, and ultra-fine bubble hydrogen water. The study results are shown in Table 3.

1) Test Results

TABLE 3

Oxidation-reduction potential of tap water, reductive hydrogen water, and ultra-fine bubble hydrogen water

| Test parameters | Tap water | Reductive hydrogen water | Ultra-fine bubble hydrogen water |
|---|---|---|---|
| pH | 7.0 | 7.4 | 7.6 |
| Oxidation-reduction potential (mV) | +320 | −550--600 | −700--750 |
| Dissolved hydrogen content (ppm) | 0.0 | 1.00-1.30 | 1.50-1.80 |
| Dissolved oxygen content (ppm) | 7.2 | 0.1-0.6 | 0.03-0.06 |

2) Outline of Results

As is shown in Table 3, because tap water was disinfected by hypochlorous acid, its oxidation-reduction potential showed the high level of +320 mV.

The oxidation-reduction potential of tap water becomes higher as the position of water within water pipes becomes closer to a water filtering plant, and reaches, for example, +600 mV. However, the oxidation-reduction potential of tap water gradually decreases as the water within water pipes is away from a water filtering plant because electrons are emitted from water to rust the iron of water pipes, reaching, for example, +250 mV. The tap water used in this test showed the normal level of oxidation-reduction potential. The reductive hydrogen water by cavitation showed high strong reducibility of about −550 mV if the supply of hydrogen was not sufficient, and if hydrogen gas was supplied to the saturation level, the reductive hydrogen water showed high strong reducibility of −600 mV.

In the ultra-fine bubble hydrogen water that was generated by subjecting fine bubbles to vacuum cavitation, due to the supersaturation state of hydrogen, the oxidation-reduction potential further decreased to the level of −700 mV--750 mV, which is capable of generating strong reduction conditions. The value of the oxidation-reduction potential in the ultra-fine bubble hydrogen water was significantly higher than that of the theoretical value in the saturated hydrogen water.

The dissolved hydrogen content was about 1.0 ppm-1.3 ppm in the reductive hydrogen water, but in the ultra-fine bubble hydrogen water, that content increased to 1.5 ppm-1.8 ppm. If the content of hydrogen gas increases in a water system, dissolved oxygen is expelled from the water system. Accordingly, the dissolved oxygen content decreased to 0.6 ppm or less in the reductive hydrogen water, and 0.06 ppm or less in the ultra-fine bubble hydrogen water.

Regarding the variation of pH value due to reduction treatment, the value of pH increased by 0.4 in the reductive hydrogen water and by 0.6 in the ultra-fine bubble hydrogen water respectively compared with tap water, and therefore both did not show significant changes. It is shown that the water subjected to reduction treatment does not become alkaline, and is safe for drinking.

Example 4 Regarding Reductive Radical Activities of Ultra-Fine Hydrogen-Bubbled Water In order to measure the volume of generated reductive radicals, the elimination capability of DPPH oxidative radical was measured.

1) Test Method

The elimination capability of oxidative radical was measured by colorimetric determination using a spectrophotometer with measuring absorbance at a wavelength of 520 nm, which uses the reaction that purple oxidative DPPH reacts with ultra-fine hydrogen-bubbled water to form colorless reductive DPPH.

The reaction formula is shown in Reaction Formula 1.

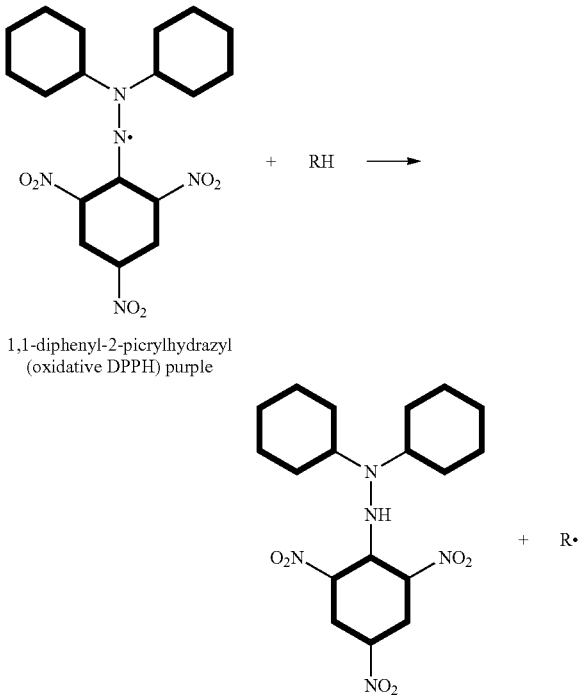

Table 4 Molecular structures and colors of oxidative DPPH and reductive DPPH

2) Measurement Results

TABLE 4

Oxidation-reduction potential and the elimination capability of DPPH oxidative radical in ultra-fine hydrogen-bubbled water.

| Parameters | No treatment | Treatment 1 | Treatment 2 | Treatment 3 | Average |
|---|---|---|---|---|---|
| Oxidation-reduction potential (mV) | +230 | −740 | −730 | −700 | −723 |
| DPPH radical elimination rate (%) | 0 | 3.84 | 3.64 | 3.26 | 3.58 |
| Radical elimination capability (μM/L/min) | 0 | 1.92 | 1.84 | 1.63 | 1.79 |

3) Outline of Measurement Results

As is shown in Table 4, in tap water with no treatment, oxidation-reduction potential was +230 mV, which showed an oxidation condition, and did not exhibit the elimination capability of oxidative radical, meaning that there were no reductive radicals. In ultra-fine hydrogen-bubbled water, oxidation-reduction potential was −700 mV or less. Patent Document 15 discloses that microbubbles generated by magnetic field processing and cavitation have free radical elimination capabilities.

On the other hand, the ultra-fine hydrogen-bubbled water produced by the present apparatus, which is not subjected to magnetic field processing, showed the radical elimination capability of 1.63 μm/L/min-1.92 μm/L/min, by which it was confirmed that the ultra-fine hydrogen-bubbled water contains reductive radicals. It was reasoned that this was caused by the fact that the size of bubbles was minute.

Example 5 Study on Production of Ultra-Fine Oxygen-Bubbled Water and the Change of Properties of Water Studied was change in the properties of tap water and ultra-fine bubble oxygen water obtained by treating tap water using the above-described ultra-fine bubble oxygen water manufacture supply apparatus. A comparative study was made by comparing oxidation-reduction potential of tap water and the ultra-fine bubble oxygen water into which oxygen was absorbed by cavitation. The study results are shown in Table 5.

1) Test Results

TABLE 5

Oxidation-reduction potential of tap water and ultra-fine bubble oxygen water

| Parameters | Tap water | Ultra-fine bubble oxygen water |
|---|---|---|
| pH | 7.0 | 6.9 |
| Oxidation-reduction potential (mV) | +320 | +330-+350 |
| Dissolved oxygen content (volume %) | 0.36 | 7.36 |

2) Outline of Results

As is shown in Table 5, the dissolved oxygen content of normal tap water was about 0.36 volume % under 1 atmosphere at a normal temperature, but adding fine bubbles to water significantly increased dissolved oxygen content to about 7.36 volume % without significant change of oxidation-reduction potential.

Water containing rich oxygen is indispensable to medical practices because it is of assistance in the recovery of physical fitness of sickly persons and patients after operations.

Example 6 Regarding Oxidative Radical Activities of Ultra-Fine Air-Bubbled Water It has been considered that it is not possible to quantitatively measure oxidative radicals using a chemical method. However, it is assumed that use of an oxidative radical absorbent might make it possible to employ a chemical method measurement, which is carried out in such a way that oxidative radicals are reacted with the normal solution of diluted sodium thiosulfate under acid conditions of sulfuric acid, and remaining sodium thiosulfate is titrated by potassium permanganate.

1) Test Method

Because the generation and disappearance of oxidative radicals of ultra-fine bubbled water occur instantly, 1M/10000 $Na_2S_2O_3$ of normal solution of diluted sodium thiosulfate was used for reaction, which was reacted with ultra-fine bubbled water for 10 minutes, remaining sodium thiosulfate was titrated by the normal solution of potassium permanganate, and the generated accumulation of oxidative radicals (integrated radicals) was estimated. The reaction is represented by Reaction Formula 2.

$$2H_2O.+2Na_2S_2O_{3(2-)}+H_2SO_4 \rightarrow 2H_2O+Na_2S_4O_{6(2-)}+Na_2SO_4$$

Reaction Formula 2

Specifically, 20 ml of ultra-fine bubbled water was reacted with 10 ml of the normal solution of diluted sodium thiosulfate for 10 minutes, remaining M/10000 $Na_2S_2O_3$ was titillated by M/1000 $KMnO_4$, and the accumulation of generated oxidative radicals were measured.

2) Test Results

Test results are shown in Table 6.

TABLE 6

Consumption of sodium thiosulfate in ultra-fine bubbled water (ml)

| Parameters | Sample A | Sample B | Sample C | Sample D | Sample E | Average |
|---|---|---|---|---|---|---|
| Blank | 1.20 | 1.20 | 1.20 | 1.20 | 1.20 | 1.20 |
| Measure value | 0.80 | 0.80 | 0.75 | 0.85 | 0.80 | 0.80 |
| Difference | 0.40 | 0.40 | 0.45 | 0.35 | 0.40 | 0.40 |

3) Outline of Results

The oxidative radical generated from the tested ultra-fine bubbled water and the sodium thiosulfate that reacts with the oxidative radical are in equivalent relationship, and the potassium permanganate used to determine quantity of sodium thiosulfate by titration and sodium thiosulfate are also in equivalent relationship.

The oxidative radical from the ultra-fine bubbled water reacts with the equivalent of sodium thiosulfate as shown by Reaction Formula 2, by obtaining the volume of sodium thiosulfate consumed by the titration of the remaining sodium thiosulfate, wheeby it is possible to obtain the volume of the oxidative radical generated in the reaction during the 10 minutes.

The formula=1 μM×difference of titiration÷volume of sample×1000÷10 min.=1 μM×0.40÷20×1000÷10 min.=2 μM/L/min As shown above, the volume of oxidative radical generated from the tested ultra-fine bubbled water was 2 μM/L/min.

The ultra-fine air-bubbled water increases dissolved oxygen concentration in water to facilitate activities of aquatic organisms, which promotes progress of water purification. The ultra-fine bubbled water manufacturing apparatus using vacuum cavitation of the present invention is capable of treating 10 tons of water per minute.

The ultra-fine air- or oxygen-bubbled water generates oxidative radicals, which activate activities of cellular tissues of a living body and promote the growth of the living body, so as to enhance the immune strength of the living body, and shorten the rearing period of livestock to reduce the cost of food to be fed.

In the crop, the water promotes nutrient absorption and photosynthesis so as to strengthen the cells and increase the activity of the roots, whereby the size of the fruit and sugar content are increased, and agricultural products having a long shelf life are supplied.

In addition, the water strengthens the resistance of crops to global warming, and therefore ultra-fine bubbles make it possible to overcome the expected future depletion of marine resources, and to cope with the expected crises in agriculture, forestry and fishery industries.

The ultra-fine bubble hydrogen water has anti-oxidation function, and therefore it is possible to use the water for the prevention of so-called lifestyle-related diseases including high blood pressure, hyperlipidemia, diabetes, heart disease, and cerebral infarction as well as cancer that have been increasing in the aging society of today.

The technique of the ultra-fine bubble oxygen water of the present invention makes it possible to manufacture high concentration oxygen water, whereby the products manufactured by this technique can be useful for the medical staff who deals with emergency situations.

The ultra-fine bubble ozone water has strong sterilizing power and can be handled safely, so that it is effective in sterilization of hospital buildings and medical devices to overcome the increase of drug-resistant bacteria such as golden staph.

The ultra-fine nitrogen- and/or carbon dioxide-bubbled water can put perishable agricultural products, livestock products, and marine products to sleep, which prevents them from being deteriorated by oxidization, and therefore it is expected the water will be widely used due to its freshness retention properties.

What is claimed is:

1. A method for manufacturing bubbled water, comprising:

providing a first pump and a second pump to generate a reduced pressure state, the two pumps sandwiching a resonance ejector and a resonance bubble-forming device;

taking in water from a water source and pressurizing the water to transfer the water to the resonance ejector by the first pump;

transferring gas from a gas supply device to a resonance ejector;

mixing the water transferred from the primary pump, and the gas transferred from the gas supply device in the resonance ejector, the resonance ejector being provided with a pressure gauge, a gas flowmeter, a resonance adjustment needle valve, and a resonance bubble-forming device;

adjusting a ratio of water to gas to be supplied and a reduced pressure level using the resonance adjustment needle valve and the pressure gauge;

subjecting the gas-liquid mixture to resonance bubble-forming in the resonance bubble-forming device to instantly generate primary bubbles of diameter of 10 μm~500 μm, whereby the mixture becomes cloudy;

transferring the primary bubbles generated in the resonance ejector and the resonance bubble-forming device to a secondary pump;

generating the reduced pressure state by the second pump, the reduced pressure state being generated by a stronger sucking capability of the second pump such that the second pump having a suction force that is capable of sucking more volume of water than the volume of water discharged from the primary pump sucks the discharged water;

allowing the entire water system including and downstream of the resonance bubble-forming device to a pump's impeller to be under the reduced pressure state, which has been generated;

expanding the primary bubbles transferred from the resonance bubble-forming device tens of times under the reduced pressure state;

crushing the expanded primary bubbles by vacuum shearing caused by the high-speed rotation of the impeller of the secondary pump, and by a striking force caused by the instant change from the reduced pressure state to the pressurized state in a casing;

generating secondary bubbles of diameter of 1 μm or less than 1 μm by vacuum cavitation that crushes the primary bubbles by double cavitation; and pressure-crushing the primary bubbles in a pressure-crushing device to make the secondary bubbles to be primary bubbles, which do not make water cloudy.

2. The method for manufacturing bubbled water of claim 1, wherein the gas is selected from air, oxygen gas, hydrogen gas, ozone gas, nitrogen gas, carbon dioxide gas and a mixture thereof.

3. The method for manufacturing bubbled water of claim 1, wherein the gas is air and/or oxygen gas.

4. The method for manufacturing bubbled water of claim 1, wherein the gas is hydrogen gas.

* * * * *